US005375415A

United States Patent [19]

Hamburg et al.

[11] Patent Number: 5,375,415

[45] Date of Patent: Dec. 27, 1994

[54] ADAPTIVE CONTROL OF EGO SENSOR OUTPUT

[75] Inventors: Douglas R. Hamburg, Bloomfield; Eleftherios M. Logothetis, Birmingham, both of Mich.

[73] Assignee: Ford Motor Company, Dearborn, Mich.

[21] Appl. No.: 158,330

[22] Filed: Nov. 29, 1993

[51] Int. Cl.[5] ..... F01N 3/20; F02D 41/14

[52] U.S. Cl. ..... 60/274; 60/276; 123/681; 123/691; 123/696

[58] Field of Search ..... 123/694, 695, 691, 681, 123/682, 683, 684, 696; 60/274, 276

[56] References Cited

U.S. PATENT DOCUMENTS

| | | | |
|---|---|---|---|
| 4,170,965 | 10/1979 | Aono | 123/695 |
| 4,272,329 | 6/1981 | Hetrick et al. | 204/1 T |
| 4,272,330 | 6/1981 | Hetrick | 204/1 T |
| 4,272,331 | 6/1981 | Hetrick | 204/1 T |
| 4,491,921 | 1/1985 | Sugiyama et al. | 123/695 |
| 4,502,444 | 3/1985 | Rubbo et al. | 123/695 |
| 4,622,809 | 11/1986 | Abthoff et al. | 60/274 |
| 5,115,639 | 5/1992 | Gopp | 60/274 |
| 5,157,919 | 10/1992 | Gopp | 60/274 |
| 5,157,920 | 10/1992 | Nakaniwa | 123/691 |
| 5,159,810 | 11/1992 | Grutter et al. | 60/274 |
| 5,168,700 | 12/1992 | Furuya | 60/274 |

OTHER PUBLICATIONS

ACS Symposium Series 309, Fundamentals and Applications of Chemical Sensors, "High-Temperature Oxygen Sensors Based on Electrochemical Oxygen Pumping" by E. M. Logothetis and R. E. Hetrick, pp. 136–154, American Chemical Society 1986 (month unknown).

*Primary Examiner*—Andrew M. Dolinar
*Attorney, Agent, or Firm*—Allan J. Lippa; Roger L. May

[57] ABSTRACT

An engine air/fuel feedback control system adjusts the engine air/fuel ratio in response to a modified output of an exhaust gas oxygen sensor. A sensor output is compared to a reference at its nominal midpoint to develop a two-state signal indicating operation rich or lean of stoichiometry. This two-state or step output is shifted towards the peak efficiency window of a catalytic converter by pumping current through a sensor electrode in response to an error signal derived from a downstream sensor. Shifts in the upstream sensor amplitude caused by current pumping are corrected by a correction factor which is adaptively learned during a test cycle.

18 Claims, 7 Drawing Sheets

ADAPTIVE CONTROL OF EGO SENSOR OUTPUT

BACKGROUND OF THE INVENTION

The field of the invention relates to control systems for maintaining engine air/fuel operation within the peak efficiency window of a catalytic converter. A particular aspect of the field relates to adaptively learning a correction value for the exhaust gas oxygen sensor output so that the output will coincide with the converter's peak efficiency window.

Air/fuel ratio feedback control systems responsive to exhaust gas oxygen sensor outputs are well-known. Conventional sensors are used which have two saturated output voltage states dependent upon presence or absence of sufficient free oxygen in the exhaust gases. Typically, the sensor output is compared to a reference selected at the approximate midpoint in the saturated output voltage states. A two-state signal is thereby derived indicating when engine air/fuel operation is either rich or lean of stoichiometric combustion.

The inventors herein have recognized several problems with the above approach. The step change of the two-state signal may not occur at the converter's peak efficiency window. Although the inventors herein have recognized that the step change may be shifted towards the window by pumping current through a sensor electrode, such current pumping may cause a shift in amplitude of the sensor output. Consequently, the reference may no longer coincide with the midpoint of the saturated output voltage states.

SUMMARY OF THE INVENTION

An object of the invention herein is to align the midpoint in an exhaust gas oxygen sensor output with the peak efficiency window of a catalytic converter.

The above object is achieved, and problems of prior approaches overcome, by providing an engine air/fuel control method for aligning a step change in the output of an exhaust gas oxygen sensor which corresponds to a predetermined air/fuel ratio with the efficiency window of a catalytic converter positioned in the engine exhaust. In one particular aspect of the invention, the method comprises the steps of: generating an error signal related to a difference between the predetermined air/fuel ratio and the converter efficiency window; shifting the step change and the corresponding predetermined air/fuel ratio towards the converter efficiency window by pumping current through an electrode of the sensor to reduce the error signal; generating a correction factor related to a change in peak-to-peak excursion of the sensor output during a test period in which engine air/fuel operation is first forced sufficiently rich and then forced sufficiently lean of a preselected air/fuel ratio to saturate the EGO sensor output in its respective rich indicating state and lean indicating state; and correcting the sensor output with the correction factor to reduce offsets in the peak-to-peak excursion caused by the pumping of the current. Preferably, fuel is adjusted to the engine in response to a feedback control signal generated in response to a comparison of a reference value to the sensor output.

An advantage of the above aspect of the invention is that the step change of the sensor output is aligned with the peak efficiency window of the catalytic converter. Another advantage is that peak-to-peak excursions of the sensor between saturated output states are adjusted or corrected so that the midpoint substantially remains at the reference value. Once again, more accurate alignment of the sensor output with the converter's peak efficiency window is obtained.

BRIEF DESCRIPTION OF THE DRAWINGS

The object and advantages of the invention claimed herein and others will be more clearly understood by reading an example of an embodiment in which the invention is used to advantage with reference to the attached drawings wherein:

DESCRIPTION OF AN EMBODIMENT

Figure 1:
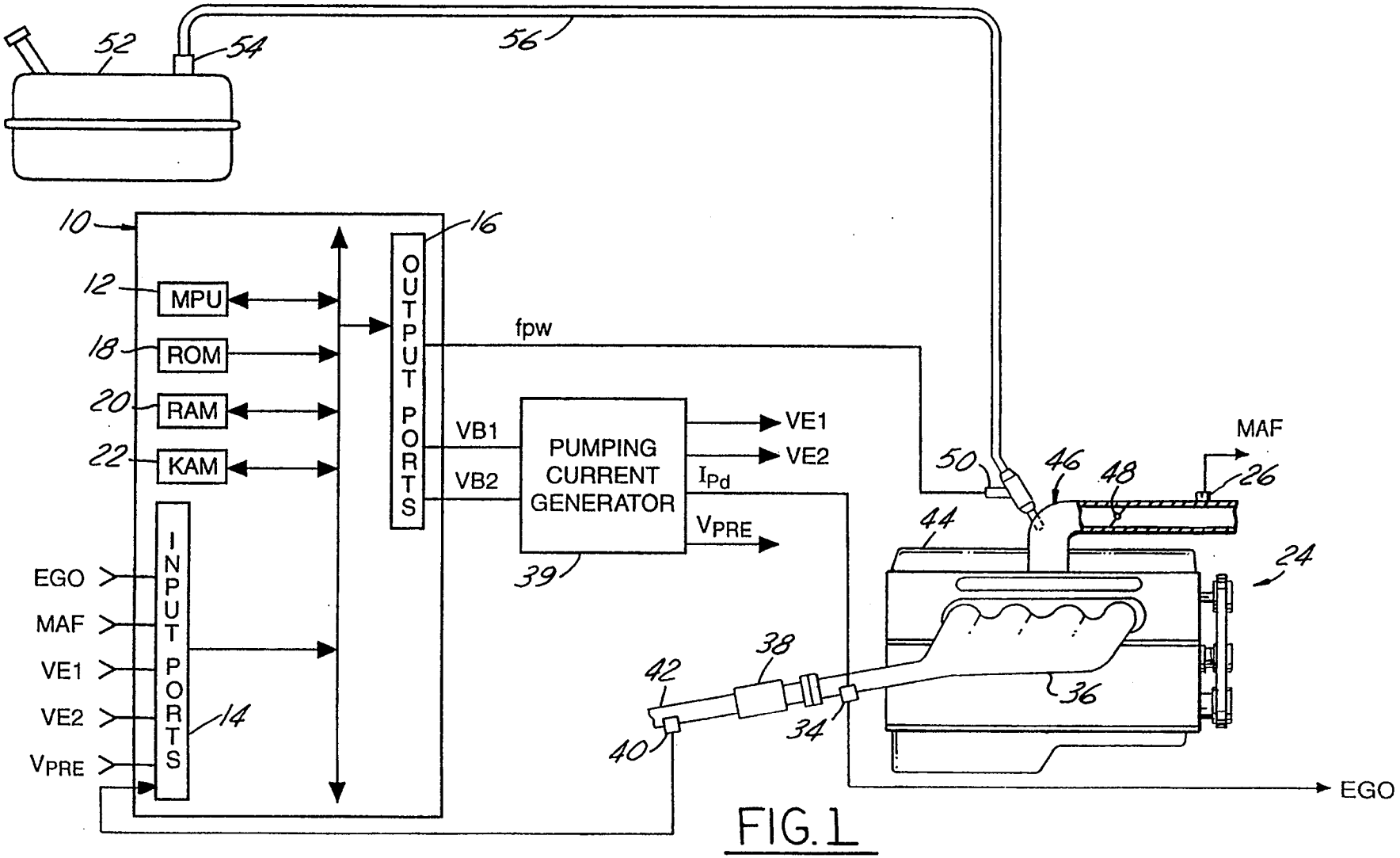
FIG. 1 is a block diagram of an embodiment wherein the invention is used to advantage.

Controller 10 is shown in the block diagram of FIG. 1 as a conventional microcomputer including: microprocessor unit 12; input ports 14 including both digital and analog inputs; output ports 16 including both digital and analog outputs; read only memory (ROM) 18 for storing control programs; random access memory (RAM) 20 for temporary data storage which may also be used for counters or timers; keep-alive memory (KAM) 22 for storing learned values; and a conventional data bus.

In this particular example, pre-catalyst exhaust gas oxygen (EGO) sensor 34 is shown coupled to exhaust manifold 36 of engine 24 upstream of conventional catalytic converter 38. Pumping current generator 39 is shown interposed between controller 10 and pre-catalyst EGO sensor 34. Post-catalyst EGO sensor 40 is shown coupled to tailpipe 42 downstream of conventional catalytic converter 38.

Intake manifold 44 is shown coupled to throttle body 46 having primary throttle plate 48 positioned therein. Throttle body 46 is also shown having fuel injector 50 coupled thereto for delivering liquid fuel in proportion to pulse width signal fpw from controller 10. Fuel is delivered to fuel injector 50 by a conventional fuel system including fuel tank 52, fuel pump 54, and fuel rail 56.

Figure 2A:
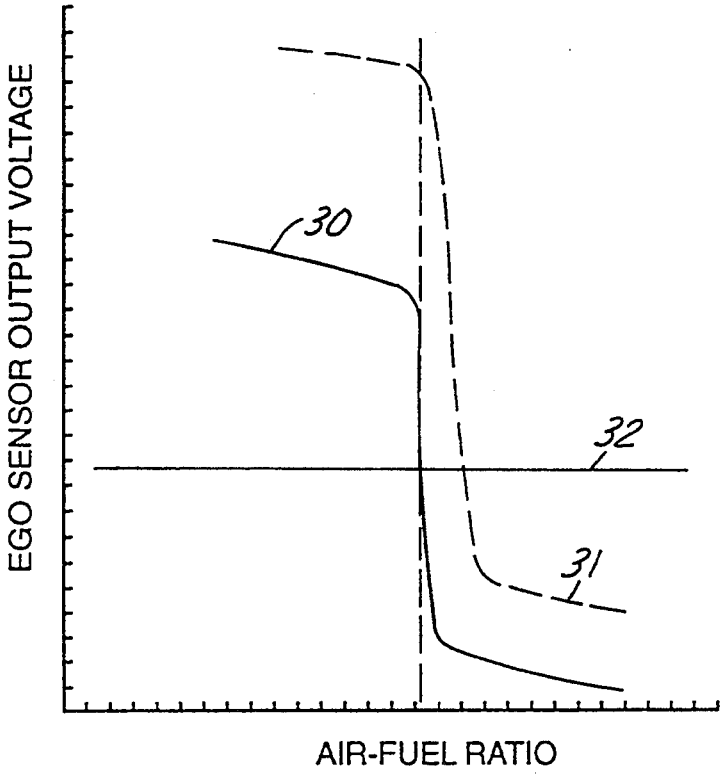
FIGS. 2A and 2B illustrate various outputs associated with an exhaust gas oxygen sensor.
Figure 2B:
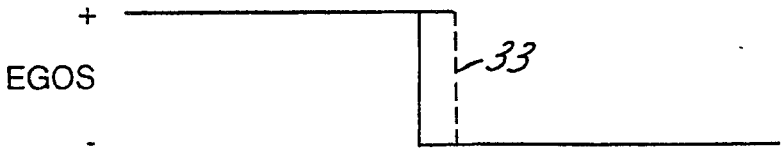

As shown in FIGS. 2A and 2B, a step change in the output amplitude of EGO sensor 34 between saturated rich and saturated lean indicating states has a midpoint which occurs at an air/fuel ratio (AFR) which is predetermined for a particular sensor. The inventors herein have found that predetermined ratio AFR may not coincide with stoichiometry or the converter's efficiency window. Further, the midpoint between saturated output states may shift with aging and temperature of an EGO sensor.

Signal EGOS, as described in greater detail later herein, is generated by comparing the output voltage of EGO sensor 34 (line 30) to a reference voltage (line 32) shown in this example at a midpoint in peak-to-peak excursion of the output step change from EGO sensor 34. Signal EGOS is a two-state signal which indicates whether combustion gases are rich or lean of the air/fuel ratio corresponding to the output midpoint from EGO sensor 34. As described in greater detail later herein, dashed lines 31 and 33 in FIGS. 2A and 2B respectively represent shifts in EGO sensor 34 output and signal EGOS which may occur with EGO sensor aging and temperature variations.

Figure 3:
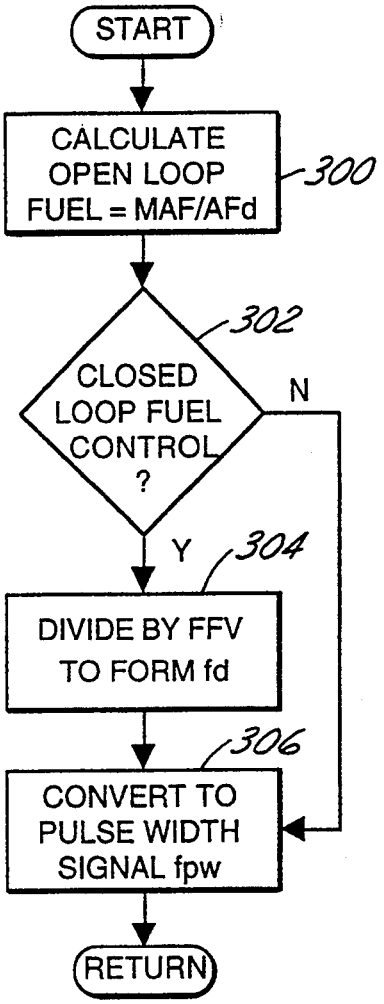
FIGS. 3 and 4 are high level flowcharts illustrating various steps performed by a portion of the embodiment illustrated in FIG. 1.

A flowchart of the liquid fuel delivery routine executed by controller 10 for controlling engine 24 is now described beginning with reference to the flowchart shown in FIG. 3. An open loop calculation of desired liquid fuel is calculated in step 300. More specifically, the measurement of inducted mass airflow (MAF) is divided by a desired air/fuel ratio (AFd) correlated with stoichiometric combustion. After a determination is made that closed loop or feedback control is desired (step 302), the open loop fuel calculation is trimmed by fuel feedback variable FFV to generate desired fuel signal fd during step 304. This desired fuel signal is converted into fuel pulse width signal fpw for actuating fuel injector 50 (step 306).

Figure 4:
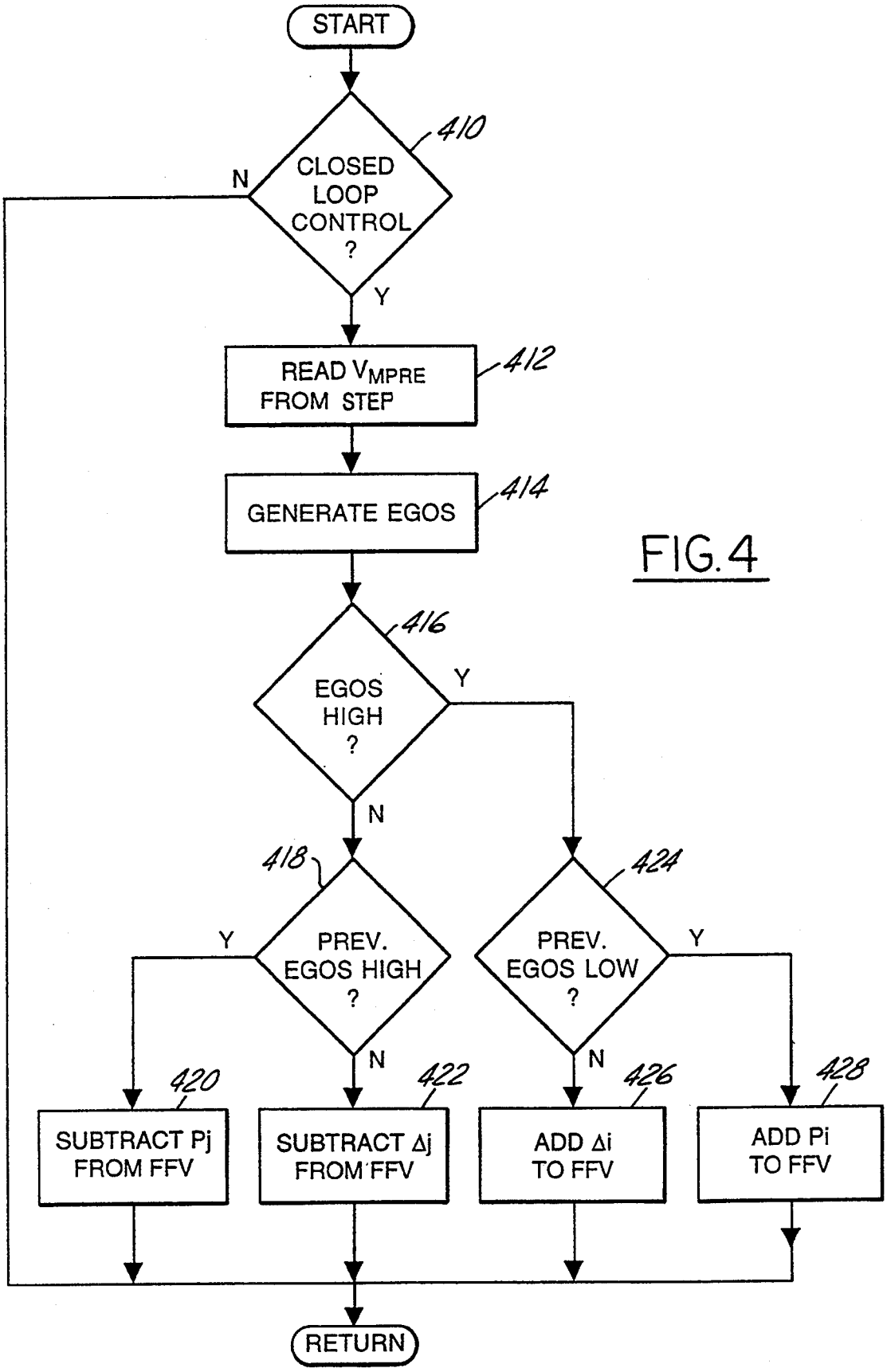

The air/fuel feedback routine executed by controller 10 to generate fuel feedback variable FFV is now described with reference to the flowchart shown in. FIG. 4. After determining that closed loop air/fuel control is desired in step 410, modified output voltage $V_{MPRE}$ derived from EGO sensor 34 is read (step 412) from the internal impedance correction routine described in greater detail later herein with reference to FIGS. 8A–8B. As also described in greater detail later herein, the step output of EGO sensor 34 is modified or shifted by biasing EGO sensor 34 in response to post-catalyst emissions feedback signal PCFS to shift the output step change towards the converter's efficiency window.

Two-state exhaust gas oxygen sensor signal EGOS is generated in step 414 by comparing modified output voltage $V_{MPRE}$ to reference 32 (see FIG. 2A). When signal EGOS is low (step 416), but was high during the previous background loop of microcontroller 10 (step 418), preselected proportional term Pj is subtracted from feedback variable FFV (step 420). When signal EGOS is low (step 416) and was also low during the previous background loop (step 418), preselected integral term Δj is subtracted from feedback variable FFV (step 422).

Similarly, when signal EGOS is high step (416), and was also high during the previous background loop of controller 10 (step 424), integral term Δi is added to feedback variable FFV (step 426). When signal EGOOS is high (step 416), but was low during the previous background loop (step 424), proportional term Pi is added to feedback variable FFV (step 428).

Figure 5:
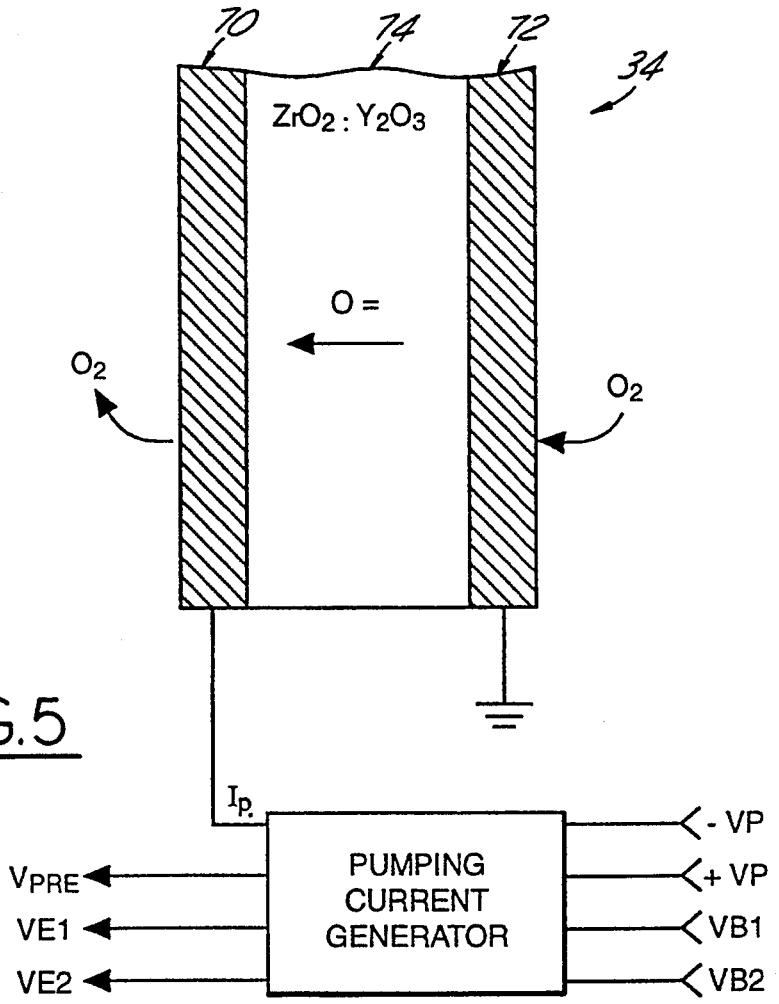
FIG. 5 is a sectional view of an exhaust gas oxygen sensor illustrating oxygen pumping in a portion thereof.

In one embodiment shown in FIG. 5, EGO sensor 34 includes first and second electrodes 70 and 72 of differing oxygen concentrations separated by oxygen-ion-conducting material 74. Theoretically, a step change or "switch point" of the sensor output coincides with the peak efficiency window of converter 38. However, the step change may be shifted to a different value because of component aging or other system characteristics. To correct for such shifts, EGO sensor 34 is biased by generating current flow in first electrode 70 so that oxygen is transferred or "pumped" from first electrode 70 to second electrode 72 or vice versa through oxygen-ion-conducting material 74. The current flow generated shifts the step change to higher or lower air/fuel values depending on the direction of the pumping current. Specifically, positive current flow in electrode 70 will shift the switch point toward leaner air/fuel ratios and negative current flow in electrode 70 will shift the switch point toward richer air/fuel ratios. Moreover, the magnitude of this shift increases proportionally with the magnitude of the current. As described in greater detail later herein, the step change in the output of EGO sensor 34 is shifted in either direction to align with the peak efficiency window of the catalyst.

Figure 6:
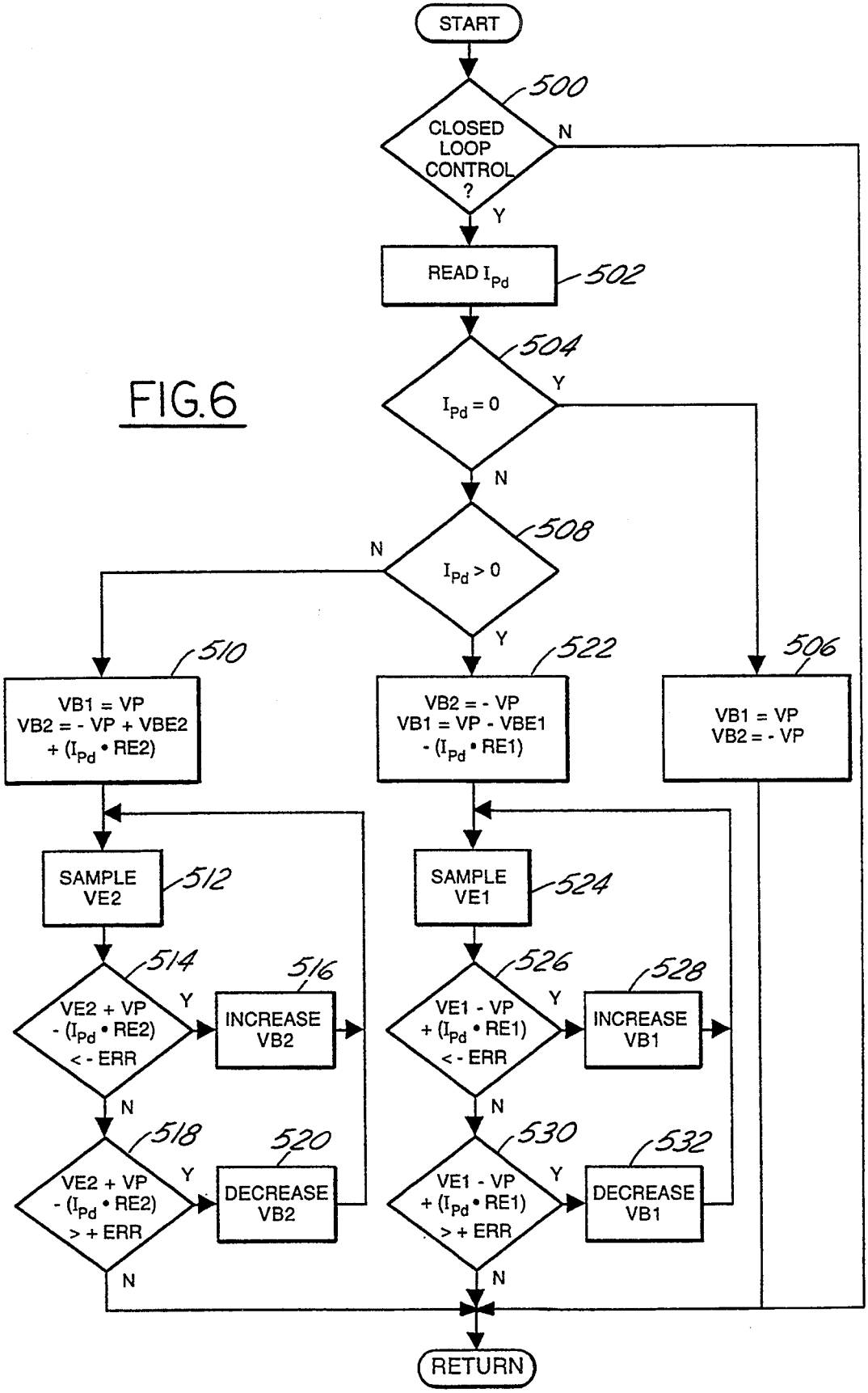
FIG. 6 is a high level flowchart illustrating various steps performed by a portion of the embodiment illustrated in FIG. 1.
Figure 7:
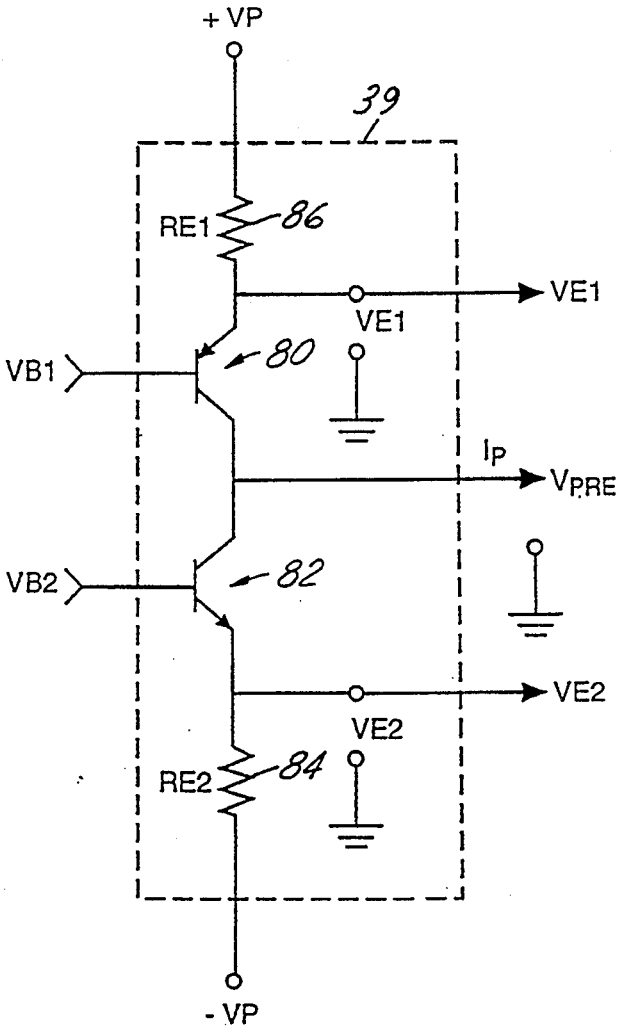
FIG. 7 is a schematic diagram of a portion of the embodiment illustrated in FIG. 1.

Biasing or shifting of EGO sensor 34 is now described in more detail with reference to the flowchart shown in FIG. 6, and the circuit diagram of pumping current generator 39 shown in FIG. 7. After determining that closed loop control is desired (step 500), desired pumping current $I_{Pd}$ is determined in response to post-catalyst emissions feedback signal PCFS (step 502). Signal PCFS is an indicator of whether the engine air/fuel, on average, is centered in the catalyst window. In the example presented herein, an error signal is generated by subtracting a reference voltage from the output of a post-catalyst emissions sensing means, such as post-catalyst EGO sensor 40 (shown in FIG. 1), and then integrating the error. When emissions feedback signal PCFS is zero (i.e., no error between average engine air/fuel ratio and the peak converter efficiency window), then desired pumping current $I_{Pd}$ is zero (step 504) and engine air/fuel is centered in the catalyst window. In this condition, no adjustment of the output step change from EGO sensor 34 is required. Accordingly, controller 10 turns off transistors 80 and 82 by setting respective base voltages VB1 and VB2 equal to positive and negative supply voltages +VP and −VP, respectively, so that pumping current will not flow in or out of pre-catalyst EGO sensor 34 (step 506).

When the engine air/fuel is not in the catalyst window, desired pumping current $I_{Pd}$ is changed responsive to emissions feedback signal PCFS so that the step change in output voltage of EGO sensor 34 will be shifted into the catalyst window. For example, when desired pumping current $I_{Pd}$ is less than zero (step 508), controller 10 turns transistor 80 off by setting VB1 equal to +VP, and operates transistor 82 in its linear range by adjusting VB2 to control the current flow out of the sensor (step 510).

Specifically, $$VB2 = -VP + VBE2 + (I_{Pd} * RE2)$$

wherein VBE2 is the internal base-to-emitter voltage of transistor 82, and RE2 is resistor 84 connected between the emitter of transistor 82 and negative supply voltage −VP. To force actual current flow $I_{Pa}$ out of electrode 70 to be equal to the desired current flow $I_{Pd}$, emitter voltage VE2 of transistor 82 is sampled by controller 10 (step 512) to check the voltage drop across resistor 84. If the voltage drop across resistor 84 is such that $VE2 + VP - (I_{Pd} * RE2)$ is less than lower error limit −ERR, then $I_{Pa}$ is less than $I_{Pd}$ (step 514). Accordingly, VB2 is slightly increased (step 516), thereby increasing the pumping current flow out of electrode 70. Conversely, if the voltage drop across resistor 84 is such that $VE2 + VP - (I_{Pd} * RE2)$ is greater than upper error limit +ERR, then current $I_{Pa}$ is greater than desired pumping current $I_{Pd}$ (step 518). Accordingly, VB2 is slightly decreased (step 520), thereby decreasing the pumping current flow out of electrode 70. Step 512 will repeat until the error is within allowable limits.

Alternatively, when desired pumping current $I_{Pd}$ is greater than zero (step 508), controller 10 turns transistor 82 off by setting VB2 equal to −VP, and operates transistor 80 in its linear range by adjusting VB1 to control the current flow into electrode 70 (step 522). Specifically, $$VB1 = VP - VBE1 - (I_{Pd} * RE1)$$

wherein VBE2 is the internal base-to-emitter voltage of transistor 80, and RE1 is resistor 86 connected between the emitter of transistor 80 and the positive supply voltage +VP. To force actual current flow $I_{Pa}$ into electrode 70 to be equal to the desired current flow $I_{Pd}$, emitter voltage VE1 of transistor 80 is sampled by controller 10 (step 524) to check the voltage drop across RE1. If the voltage drop across resistor 86 is such that VE1−VP+($I_{Pd}$*RE1) is less than some lower error limit −ERR, then $I_{Pa}$ is greater than $I_{Pd}$ (step 526). Accordingly, VB1 is slightly increased (step 528), thereby decreasing the pumping current flow into electrode 70. Conversely, if the voltage drop across resistor 86 is such that VE1−VP+($I_{Pd}$*RE1) is greater than some upper error limit, +ERR, then $I_{Pa}$ is less than $I_{Pd}$ (step 530). Accordingly, VB1 is slightly decreased (step 532), thereby increasing the pumping current being pumped into electrode 70. Step 524 will repeat until the error is within allowable limits.

Pumping current into or out of EGO sensor 34 not only shifts the step change of the sensor output relative to engine air/fuel ratio, but also results in a shift in the output voltage level due to a voltage drop across the internal impedance of EGO sensor 34. Voltage adjustment is provided to compensate for this shift in voltage level as described below with reference to FIGS. 8A–8B. Generally, the internal impedance of EGO sensor 34 is estimated from a look up table having engine speed and load as estimators of sensor temperature and, accordingly, inputs to the look up table. The inventors herein have recognized that this internal impedance look up method may have reduced accuracy as EGO sensor 34 ages, and accuracy may also be reduced due to variations in internal impedance among sensors. Accordingly, the following adaptive routine is used to learn a correction value to be applied to the impedance value read from the look up table.

Figure 8A:
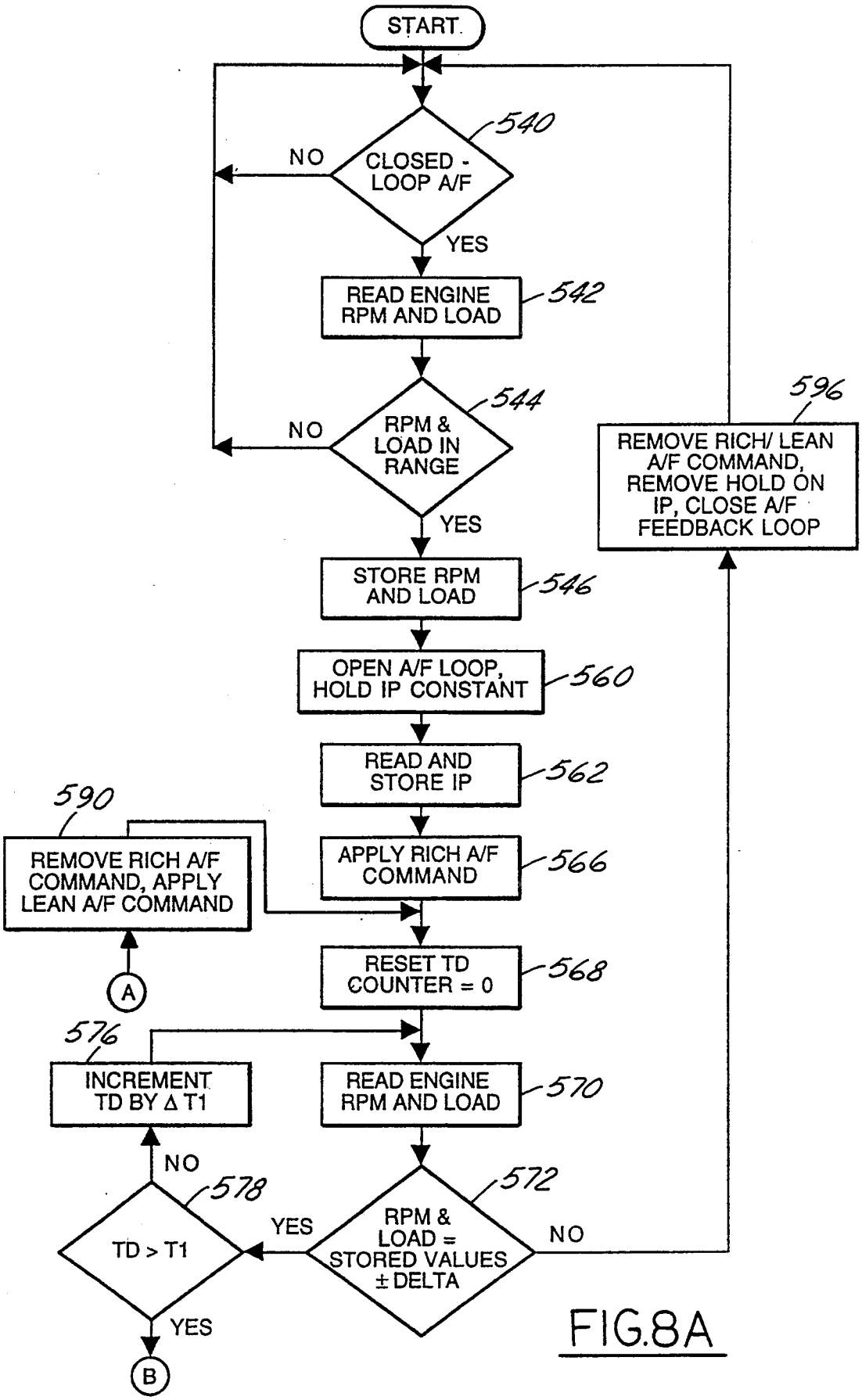
FIGS. 8A–8B are high level flowcharts illustrating various steps performed by a portion of the embodiment illustrated in FIG. 1.
Figure 8B:
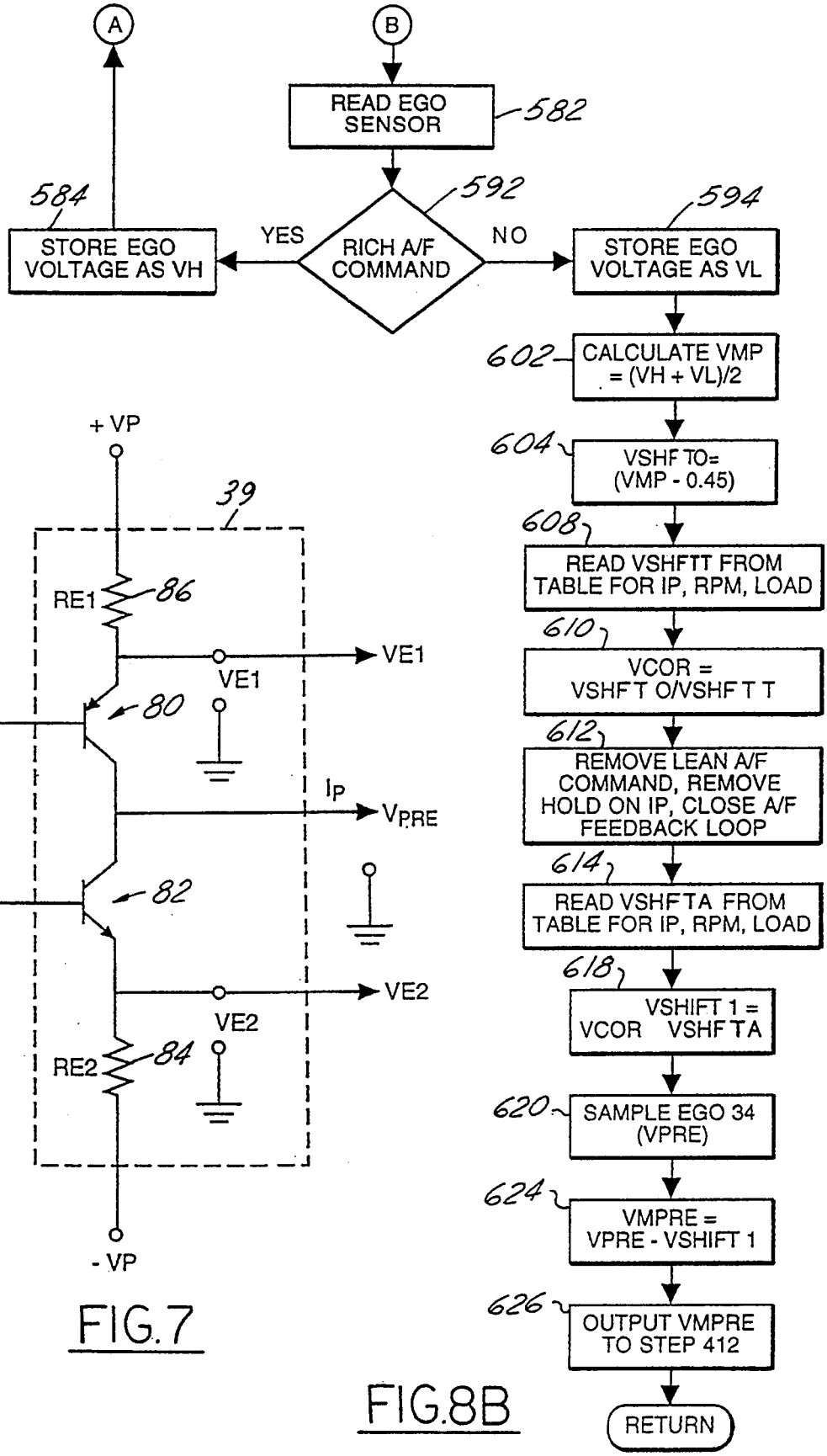

The adaptive correction is now described with reference to FIGS. 8A–8B. After closed loop or feedback air/fuel control is enabled (step 540), engine speed and load are read (step 542) and stored (step 546) if they are within a preselected range (step 544). Closed loop feedback control is then disabled and pumping current IP is held constant at its last value which is read and stored (steps 560 and 562).

While feedback air/fuel control is disabled, a rich open loop offset is applied to the engine air/fuel ratio during step 566. This rich offset is sufficient to saturate the output of EGO sensor 34 in the rich indicating direction. Concurrently, counter TD is reset to zero in step 568. While engine speed and load are within predetermined range DELTA of the previously stored rpm and load values (steps 570 and 572), counter TD is incremented by amount ΔT1 (step 576). When counter TD reaches maximum count T1 (step 578), the output voltage of EGO sensor 34 is read (step 582) and stored as value VH (step 584). Subsequently, the rich open loop air/fuel command is disabled and a lean open loop air/fuel command is enabled during step 590. The lean offset is sufficient to saturate the output of EGO sensor 34 in the lean indicating direction.

The operation described above with respect to the rich air/fuel command is then repeated for lean operation until counter TD reaches maximum value T1 (steps 568–578). EGO sensor 34 is then read (step 582) and its output voltage stored as voltage VL (steps 592–594). If at anytime during the above described operation, engine speed and load exceed the previously stored values (step 546) by amount DELTA (step 572), then feedback air/fuel control is resumed, the rich and lean air/fuel commands removed, and the hold on pumping current IP is also removed (step 596).

After high and low voltages VH and VL are stored, the average thereof is determined in step 602. Stated another way, the mean value of peak-to-peak excursions in the output of EGO sensor 34 is calculated during a test period in which engine 24 is forced to operate rich and subsequently lean for predetermined times. The shift in this average value from the initial midpoint reference (see line 32 in FIG. 2A) is then determined during step 604 and its output signal designated as VSHFT0. Estimated voltage shift VSHFTT is then read from a look up table having engine rpm and load, and the previously held value of pumping current IP as its inputs during step 608. Correction ratio VCOR is then determined by dividing voltage shift VSHFTT from the look up table into voltage shift VSHFT0 which was observed or calculated during the above described test (step 610). The lean air/fuel commuted is then removed, the hold and pumping current IP removed, and feedback air/fuel closed loop control resumed during step 612, thereby concluding an adaptive learning process.

Having adaptively learned correction ratio VCOR, it is then applied during feedback air/fuel control as follows. Actual voltage shift VSHFTA is read from a look up table having pumping current IP, engine rpm and load as inputs (step 614). Voltage shift VSHFT1 is then determined by multiplying correction ratio VCOR times voltage shift VSHTA. Accordingly, an adaptively learned correction ratio is multiplied times the looked up value to correct for variations in EGO sensor 34 output caused by factors such as aging or variations among sensors.

The actual value of EGO sensor 34 output is subsequently sampled as signal VPRE in step 620. During step 624, sampled EGO sensor output VPRE is modified or corrected by subtracting previously determined voltage VSHFT1. The resulting modified voltage (VMPRE) is then transferred to step 412 in FIG. 4 and feedback air/fuel control performed as previously described herein.

Although one example of an embodiment which practices the invention has been described herein, there are numerous other examples which could also be described. For example, other combinations of analog devices and discrete ICs may be used to advantage to generate the current flow in the sensor electrode. The invention is therefore to be defined only in accordance with the following claims.

What is claimed:

1. An engine air/fuel control method for aligning a step change in output of an exhaust gas oxygen sensor which corresponds to a predetermined air/fuel ratio with the efficiency window of a catalytic converter positioned in the engine exhaust, comprising the steps of:

generating an error signal related to a difference between the predetermined air/fuel ratio and the converter efficiency window;

shifting the step change and the corresponding predetermined air/fuel ratio towards the converter efficiency window by pumping current through an electrode of the sensor to reduce said error signal;

generating a correction factor related to a change in peak-to-peak excursion of said sensor output during a test period in which engine air/fuel operation is first forced sufficiently rich and then forced sufficiently lean of a preselected air/fuel ratio to saturate the EGO sensor output in its respective rich indicating state and lean indicating state; and correcting said sensor output with said correction factor to reduce variations in said peak-to-peak excursion caused by said pumping of said current.

2. The method recited in claim 1 further comprising the steps of generating a feedback control signal in response to a comparison of a reference value to said sensor output and adjusting fuel to the engine in response to said feedback control signal.

3. The method recited in claim 2 wherein said step of adjusting fuel in response to said feedback control signal is disabled during said test period.

4. The method recited in claim 1 wherein said pumping current is held at a constant value during said test period.

5. The method recited in claim 2 wherein said step of generating said correction factor further comprises the step of determining an actual voltage shift in said sensor output from said reference value by subtracting said reference value from a midpoint between said peak excursions during said test period.

6. The method recited in claim 5 wherein said step of generating said correction factor further comprises the step of generating a correction ratio of said actual voltage shift to an estimated voltage shift.

7. The method recited in claim 6 wherein said estimated voltage shift is estimated from engine speed and load and said constant pumping current during said test period.

8. The method recited in claim 7 wherein said step of generating said correction factor further comprises a step of multiplying said correction ratio times a second estimated voltage shift.

9. The method recited in claim 8 wherein said second estimated voltage shift is related to said pumping current.

10. The method recited in claim 9 wherein said second estimated voltage shift is also related to engine speed and engine load.

11. An engine air/fuel control method for aligning a midpoint in peak-to-peak excursion of a step change in output of an exhaust gas oxygen sensor which occurs at a predetermined air/fuel ratio with the efficiency window of a catalytic converter positioned in the engine exhaust, comprising the steps of:

controlling the engine air/fuel ratio in response to a comparison of the sensor output with a reference value;

generating an error signal related to a difference between the predetermined air/fuel ratio and the converter efficiency window;

shifting the step change and the predetermined air/fuel ratio towards the converter efficiency window by pumping current through an electrode of the sensor to reduce said error signal;

generating a correction factor related to a difference between a midpoint between the peak-to-peak amplitude of the sensor output and said reference value during a test period in which engine air/fuel operation is first forced sufficiently rich and then forced sufficiently lean of stoichiometric combustion to saturate the sensor output; and correcting the sensor output with said correction factor to reduce variations in the peak-to-peak excursion caused by said pumping of said current.

12. The method recited in claim 11 wherein said correcting step aligns said reference value with said midpoint.

13. The method recited in claim 11 wherein said engine air/fuel ratio controlling step is also responsive to said error signal.

14. The method recited in claim 11 wherein said correction factor generating step occurs during a test period in which both said pumping current is held constant and said step of controlling the engine air/fuel ratio is forced to be independent of said sensor output.

15. An engine air/fuel control method for aligning a midpoint in peak-to-peak excursion of a step change in output of an exhaust gas oxygen sensor which occurs at a predetermined air/fuel ratio with the efficiency window of a catalytic converter positioned in the engine exhaust, comprising the steps of:

generating an error signal related to a difference between the predetermined air/fuel ratio and the converter efficiency window;

feedback control of the engine air/fuel ratio in response to a feedback variable derived by integrating a difference between the sensor output and a reference value, said feedback control also being responsive to said error signal;

shifting the step change and the predetermined air/fuel ratio towards the converter efficiency window by pumping current through an electrode of the sensor to reduce said error signal;

disabling said feedback and holding said pumping current at a constant value during a test period;

forcing engine air/fuel operation lean for a predetermined time and rich for a preselected time during said test period;

generating a correction ratio of a difference between a midpoint of the peak-to-peak excursion of the sensor output and said reference value to a stored value related to said pumping current during said test period; and correcting the sensor output with said correction ratio to reduce offsets in the peak-to-peak excursion caused by said pumping current.

16. The method recited in claim 15 wherein said correcting step further comprises the steps of predicting a voltage offset induced by said pumping current and multiplying said predicted voltage offset by said correction ratio to generate a voltage correction and adjusting the sensor output with said voltage correction.

17. The method recited in claim 15 wherein said test period predetermined time and preselected time are substantially equivalent.

18. The method recited in claim 16 wherein said step of predicting said voltage offset comprises a look up table addressed by said pumping current and engine speed and engine load.

* * * * *